US008584327B1

(12) United States Patent
Kodak

(10) Patent No.: US 8,584,327 B1
(45) Date of Patent: Nov. 19, 2013

(54) MAGNETIC MODULAR CASKET

(71) Applicant: James Allen Kodak, Odenton, MD (US)

(72) Inventor: James Allen Kodak, Odenton, MD (US)

( * ) Notice: Subject to any disclaimer, the term of this patent is extended or adjusted under 35 U.S.C. 154(b) by 0 days.

(21) Appl. No.: 13/626,278

(22) Filed: Sep. 25, 2012

(51) Int. Cl.
*A61G 17/00* (2006.01)

(52) U.S. Cl.
USPC ..... 27/2; 220/4.28

(58) Field of Classification Search
USPC ..... 27/2, 3, 4, 35; 220/4.28, 230, 622, 692, 220/4.33; 292/251.5; 206/600
See application file for complete search history.

(56) References Cited

U.S. PATENT DOCUMENTS

| | | | | |
|---|---|---|---|---|
| 1,373,730 | A * | 4/1921 | Hollins | 27/2 |
| 4,800,631 | A * | 1/1989 | Pellmann | 27/7 |
| 6,314,626 | B1 * | 11/2001 | Becker | 27/4 |
| 7,222,400 | B2 * | 5/2007 | Leverett | 27/19 |
| 7,730,595 | B2 * | 6/2010 | De La Fuente et al. | 27/2 |
| 8,152,014 | B2 * | 4/2012 | Elstone et al. | 220/6 |
| 8,167,157 | B2 * | 5/2012 | Shalomoff | 220/4.28 |
| 8,291,556 | B2 * | 10/2012 | Brownlow et al. | 27/3 |
| 2007/0170085 | A1 * | 7/2007 | Hoogland | 206/600 |
| 2009/0261093 | A1 * | 10/2009 | Fullerton et al. | 220/4.28 |

* cited by examiner

*Primary Examiner* — William Miller

(57) ABSTRACT

Enclosed is a design for a modular casket that is assembled without the use of tools. The sides of the caskets adhere to the bottom of the casket through an array of magnets that is actuated only after proper alignment. Once assembled, movement of the side panels as a result of any lateral force is retarded by the magnetic force and through the use of dowels connecting the panels near the top of the side panels.

12 Claims, 5 Drawing Sheets

MAGNETIC MODULAR CASKET

BACKGROUND OF THE INVENTION

Caskets are fundamentally bulky items and are thus expensive to ship. Modularity of casket design enhances shipment by breaking down the otherwise bulky casket into a plurality of easily transportable boxes. However, modularity necessitates assembly that may prove too time-consuming or too complex for many end point users. There is thus a need in the casket market for a modular design that can be quickly and easily assembled and preferably without the use of tools.

Efforts to design modular and/or collapsible caskets date back nearly a century. For instance, U.S. Pat. No. 1,349,799 provides a collapsible design and U.S. Pat. No. 1,373,730 provides for separable connected members. A more modern design, see U.S. Pat. No. 3,924,309, divides a casket into its upper, middle and lower bands and allows for relatively quick reassembly. This succeeds at decreasing the weight of any one parcel, but still yields three parcels that are still as long as a casket and thus quite unwieldy. Other efforts succeed at breaking casket members down to smaller sizes, but make assembly too cumbersome. See, for example, U.S. Pat. Nos. 4,800,631; 6,269,526; 7,222,400; 7,614,131; and 7,730,595.

SUMMARY OF THE INVENTION

The object of this invention is to provide a practical and sleek casket design that can be easily shipped and quickly assembled by any user without the use of tools. This is achieved by the provision of a modular casket comprised of 16 roughly planar pieces that adhere together through the controlled actuation of magnetic force. Upon proper alignment of the side panels within a groove around the periphery of the base, removal of support pins from the interior side of the side panels forces a magnetic plate downward to mate with a large ferromagnetic strip at the bottom of the base groove. The upper portions of the side panels are aligned and held together through the use of magnetic dowels that mate with permanent magnets embedded within the side panels. The lid pieces are also held in place through a direct and less powerful magnetic force.

BRIEF DESCRIPTION OF THE DRAWINGS

An embodiment of the present invention will now be described by the way of an example and with references to the accompanying drawings, in which.

DETAILED DESCRIPTION OF THE INVENTION

Figure 1:
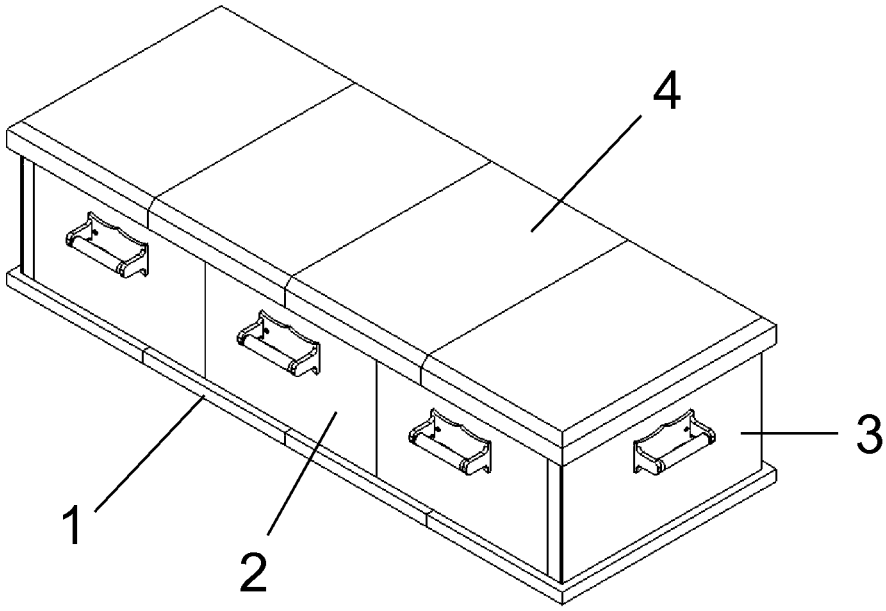
FIG. 1 illustrates a perspective view of the modular casket.

The preferred embodiment is a modular casket as shown in FIG. 1. It is generally rectangular and consists of a base 1 that is partitioned into four parts of equal dimension. Attaching to the base 1 are six equivalent side panels 2, three to each long side, and two equivalent end panels 3, one to each short side. The lid of the casket 4, like the base, is also partitioned into four parts of equal dimension.

Figure 2:
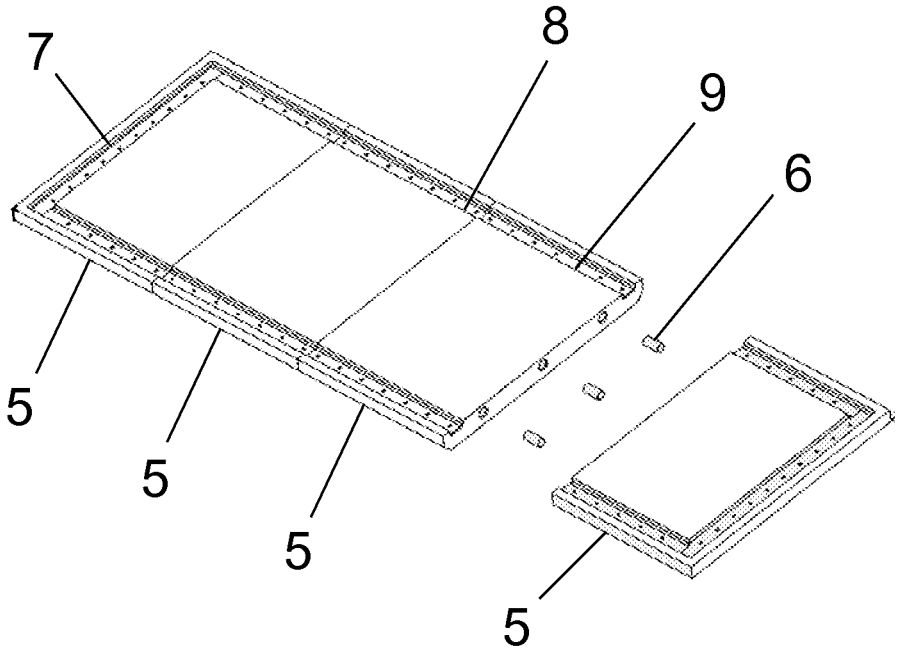
FIG. 2 illustrates a perspective view of the casket base with one end exploded.

FIG. 2 is the base with one end exploded to reveal how the four parts 5 align with one another with the use of dowels 6. There is a groove 7 that runs along the outer portion of each part of the base. This groove 7 is partly filled in with a ferromagnetic strip 8, preferably steel, and this ferromagnetic strip 8 is attached to the bottom of the groove with screws 9. The portion of the groove 7 above the magnetic strip 8 is used for receiving and aligning the side panels.

Figure 3:
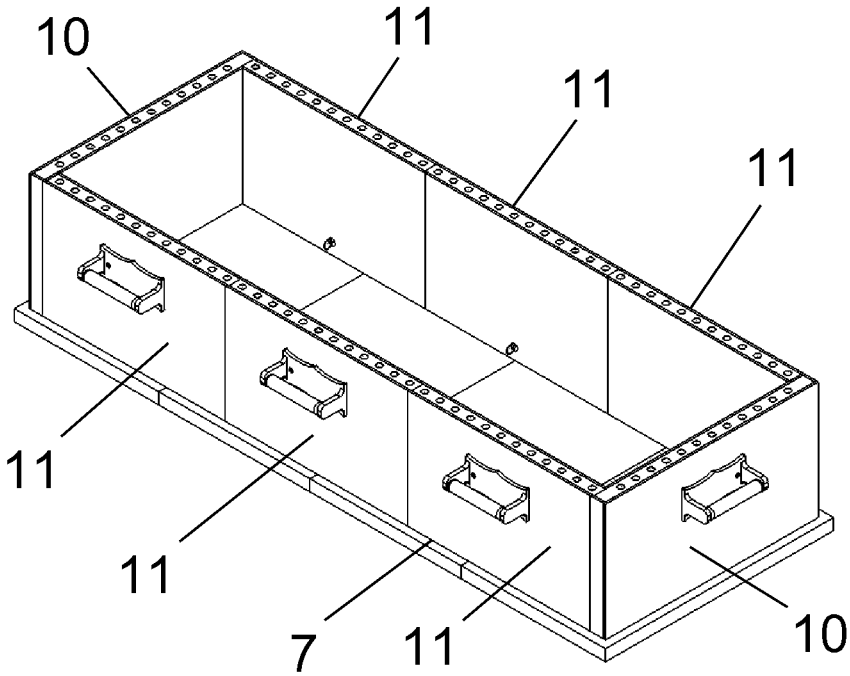
FIG. 3 illustrates a perspective view of the side panels placed in the base groove.

FIG. 3 shows how the side panels align within the base groove 7. The side panels are comprised of two different types of panels: there are two equivalent ends panels 10 and six equivalent flanking panels 11.

Figure 4:
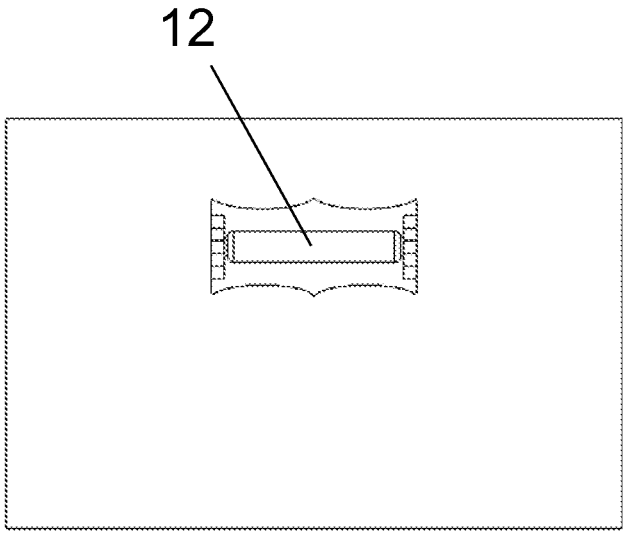
FIG. 4 illustrates an exterior view of a flanking panel with a handle.

FIG. 4 is the exterior view of a flanking panel. It contains a centered handle portion 12 that is used for lifting the casket. The handle portion 12 is attached to the side panel via dowels, screws, nails, glue or some combination thereof. The exterior of the end panel is equivalent except for the absence of a handle. Typically handle portions are placed to the side of caskets.

Figure 5:
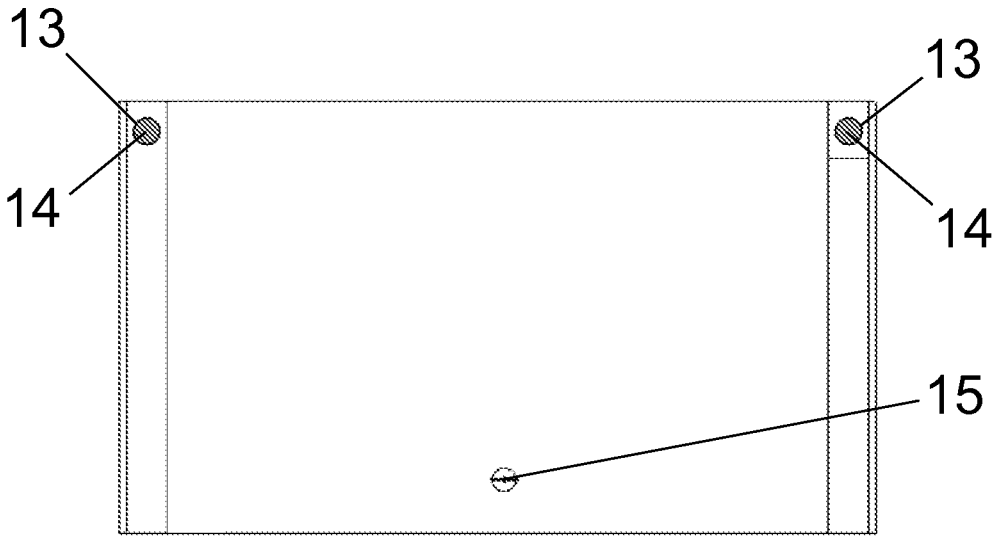
FIG. 5 illustrates the interior view of an end panel.

FIG. 5 is the interior view of an end panel. The end panel mates with the ends of the flanking panels via magnetic dowels inserted into holes 13 near the top of each panel type. Use of dowels provides for proper alignment as well as rigidity at the top of the casket. The dowel holes 13 are partly filled with a permanent magnet 14 that is glued or otherwise mounted to the bottom of the hole. This permanent magnet 14 is properly oriented to attract the magnetic dowel. This view, like interior view of all side panels, shows the access to the support pin 15. The support pin holds up the magnetic plate nestled inside the side panels and it is preferably a ball locking pin with a ring handle. After all side panels are properly aligned, the support pins 15 are pulled out to actuate the magnetic force between the side panels and the base. Once the force is actuated, the support pins 15 can either be discarded or placed back in the original position.

Figure 6:
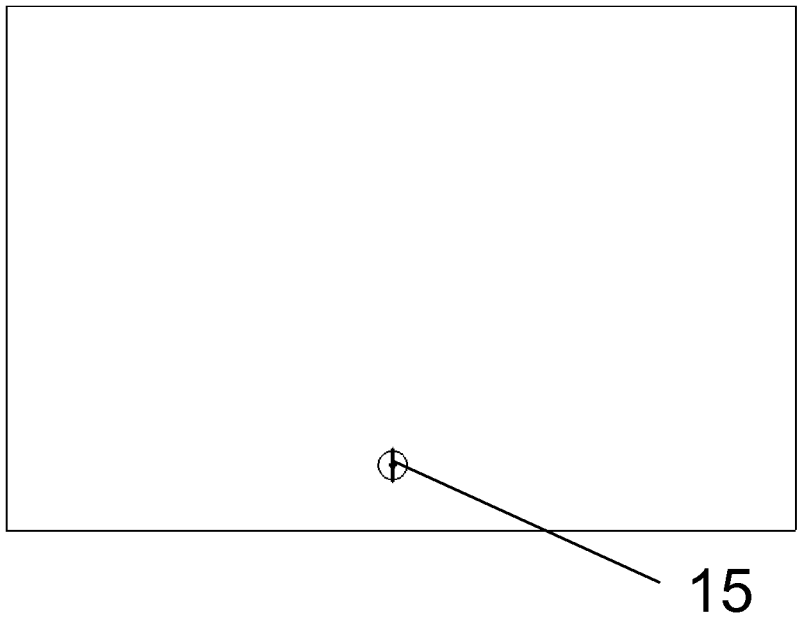
FIG. 6 illustrates the interior view of a flanking panel.

FIG. 6 is the interior view of a flanking panel. Like the end panel of FIG. 5, it has support pins 15, but the holes for receiving the magnetic dowels are to the sides and thus are not visible in this view.

Figure 7:
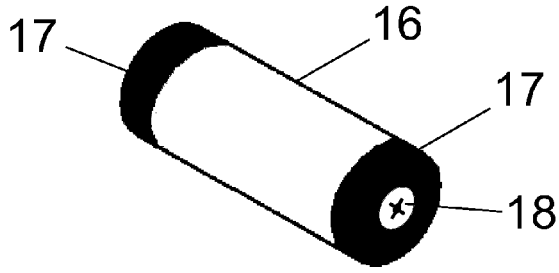
FIG. 7 illustrates a perspective view of a magnetic dowel.

FIG. 7 is the dowel 16 with permanent magnets 17 attached to the ends. These permanents magnets 17 are preferably attached to the dowel ends with a screw 18.

Figure 8:
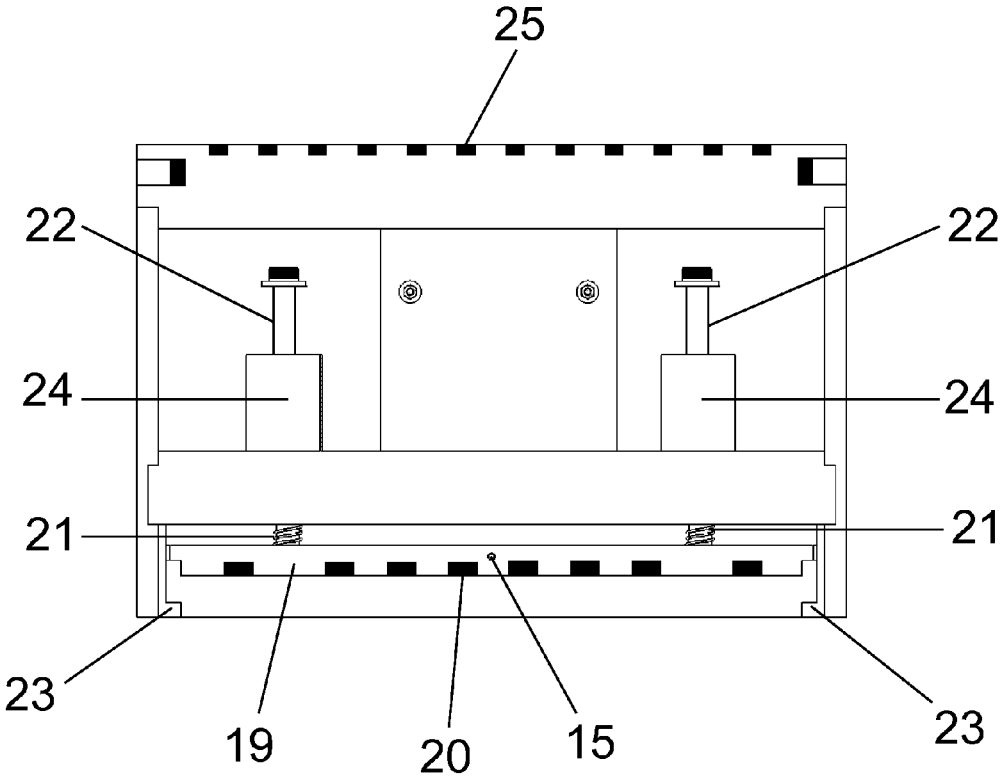
FIG. 8 illustrates the internal view of a side panel.

FIG. 8 is the equivalent internal view of all side panels. It demonstrates the entire mechanism for attaching the side panels to the base. It also reveals the mechanics of lateral attachment to other side panels and attachment of the lid. There is a magnetic plate 19 that houses an array of permanent disc magnets 20. Prior to attachment, the magnetic plate 19 is held several inches above the bottom of the side panel and is held in place with a support pin 15. After the support pin 15 is removed, the magnetic plate 19 falls to the bottom with the assistance of springs 21 and mates with the ferromagnetic strip in the base. This action is hereafter referred to as actuation. To enhance the force of attraction between the magnetic plates 19 and the base, the ferromagnetic strip within the base can be replaced by disc magnets mounted within the groove of the base. However, since this introduces additional costs and complexity with respect to alignment, the use of high flux rare-earth magnets, such as neodymium-iron-boron or samarium-cobalt along with a robust ferromagnetic strip is preferred. It is ideal for the support pin 15 to possess a rectangular cross-section. A rectangular cross-section, as opposed to the more common circular design, assists in preventing the magnetic plate from pivoting clockwise or counterclockwise around the support pin pre-actuation. Inhibiting said rotation should assure proper alignment within the side panel and prevent malfunction.

Upon actuation, the maximum distance traveled by the magnetic plate is limited by three separate components: the length of the guide posts 22 which attach to the magnetic plate 19 at one end and possess flange cap nuts at the other end, the side support lips 23, and the magnetic strip in the base with which the magnetic plate mates. It is critical to maintain a high degree of precision amongst these three components. The magnetic plates must contact or come in very close contact with the magnetic strip in the base in order to maximize the force of attraction and thus the lift capacity of the casket. Additionally, this force must be counteracted by components within the side panels so that when the casket is lifted from the handles it carries the magnetic plates and the mated base along with them. The force transferring components are both the flange nut caps at the end of the guide posts 22 and the side support lips 22. In order for both of these components to contribute to the lifting of the magnetic plate, the flange of the cap nuts must contact the weight support boards 24 just as the sides of the magnetic plate contact the support lips 23. Either method may prove sufficient on its own to support the weight held up by the magnetic plate 19. Since both are easily employed, the preferred embodiment incorporates both.

The side ends of the side panels mate with the dowels 16 possessing ends of opposite polarity to the magnets 14 nestled inside the dowel holes 13. The dowels 16 provide a means to align the panels as well as provide lateral strength. With ends of opposite polarity to the magnets 14 within the dowel holes, the dowels 16 not only provide rigidity but draw the side panels tightly together. This closeness helps to assure proper alignment prior to actuation. After actuation, any adjustments to alignment will require special levers or other means that will be impractical to the average consumer. It is therefore imperative that proper alignment be assured prior to actuation. There is also an array of permanent disc magnets 25 nestled into the top of each side panel. These magnets 25 are used to attract the magnetic strip within the lid groove.

Figure 9:
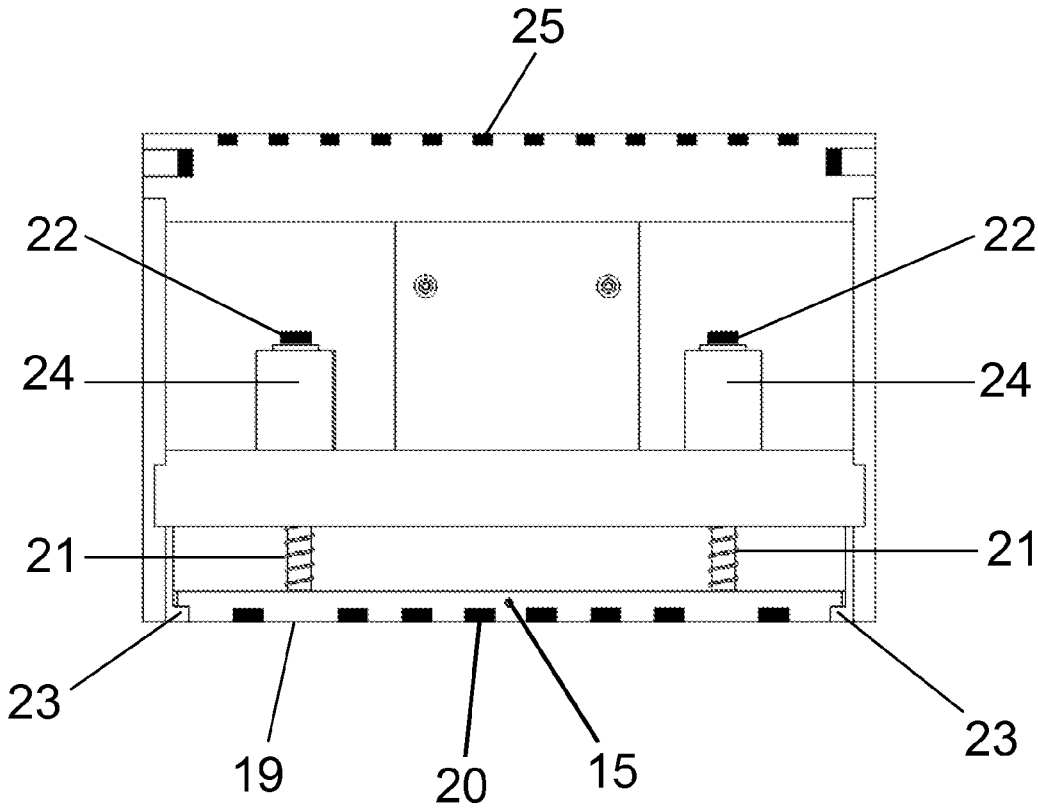
FIG. 9 illustrates the interior view of a side panel post-actuation.

FIG. 9 provides an internal view post-actuation. After removal of the support pin 15, the force of gravity, the tension of the springs 21, and some very slight magnetic force draws the magnetic plate 19 to the bottom of the side panel and towards the ferromagnetic strip within the base.

Figure 10:
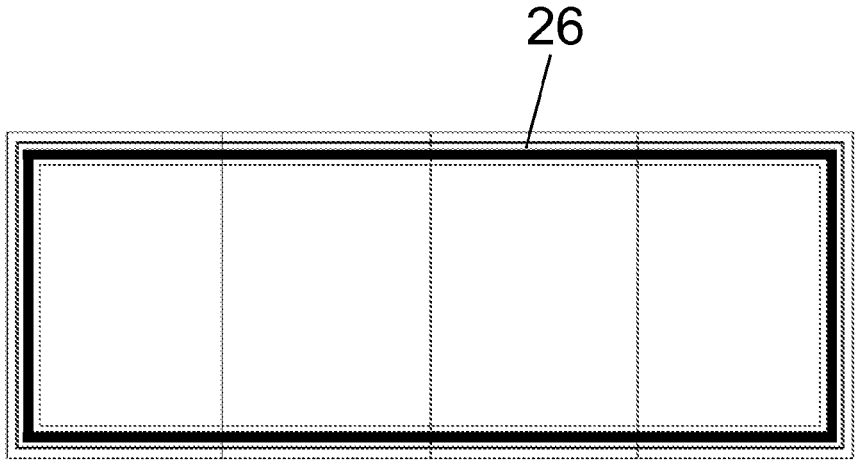
FIG. 10 illustrates the interior view of the casket lid.

FIG. 10 is the bottom view of the lid with a groove 26 cut along the interior periphery of each lid portion with dimensions complementary to the side panels enabling alignment and seating over the same. The groove 26 is partially filled with a flexible ferromagnetic strip that is glued or otherwise attached to the bottom of the groove. The flexible ferromagnetic strip is used for sealing the lid portions to the tops of the end panels but not with so much force as to inhibit easy removal of said lid portions. This easy removal will facilitate viewing of the body. Furthermore, a weaker magnetic force will enable fine adjustments to the alignment of the individual lid portions. The necessary play between the lid groove 26 and the tops of the side panels may require these fine adjustments for aesthetic purposes.

I claim:

1. A modular casket comprising an attractive magnetic force attaching side panels to a base via a board nestled within each side panel bearing a series of permanent magnets that mates with either a ferromagnetic strip or with other permanent magnets properly aligned and in the proper orientation within the base to permit the attractive magnetic force upon actuation, with actuation involving the application of the magnetic force upon the removal of a support pin or other support means holding the magnet bearing board a significant distance away from the ferromagnetic strip or other permanent magnets within the base.

2. The modular casket as in claim 1, comprising:

a.) a dowel for connecting the side panels that has permanent magnets mounted on each end that mate with the permanent magnets within each side panel.

3. The modular casket as in claim 1, comprising:

a.) a dowel for connecting the side panels that has permanent magnets mounted on each end that mate with the permanent magnets within each side panel; and b.) the support pin or other support means possessing a rectangular cross-section.

4. The modular casket as in claim 1, comprising:

a.) a dowel for connecting the side panels that has permanent magnets mounted on each end that mate with the permanent magnets within each side panel;

b.) the support pin or other support means possessing a rectangular cross-section; and c.) compressed springs that force movement of the magnet bearing board towards the base after removal of the support pin or other support means.

5. A modular casket comprising an attractive magnetic force attaching side panels to a base via a board nestled within each side panel bearing a series of permanent magnets that mates with either a ferromagnetic strip or with other permanent magnets properly aligned and in the proper orientation within the base to permit the attractive magnetic force upon actuation, with actuation involving the application of the magnetic force upon the removal of a support pin or other support means holding the magnet bearing board a significant distance away from the ferromagnetic strip or other permanent magnets within the base; and the attractive magnetic force between the base and the magnet bearing board is transferred to the rest of the side panel by a support mechanism involving one or more rods within the side panel that are connected at one end to the magnet bearing board and at the other end to a flanged nut cap which inhibits further movement of the magnet bearing board towards the base when the flanged end nut cap engages a support beam.

6. The modular casket as in claim 5, comprising:

a.) a dowel for connecting the side panels that has permanent magnets mounted on each end that mate with the permanent magnets within each side panel.

7. The modular casket as in claim 5, comprising:

a.) a dowel for connecting the side panels that has permanent magnets mounted on each end that mate with the permanent magnets within each side panel; and b.) the support pin or other support means possessing a rectangular cross-section.

8. The modular casket as in claim 5, comprising:

a.) a dowel for connecting the side panels that has permanent magnets mounted on each end that mate with the permanent magnets within each side panel;

b.) the support pin or other support means possessing a rectangular cross-section; and c.) compressed springs that force movement of the magnet bearing board towards the base after removal of the support pin or other support means.

9. A modular casket comprising a attractive magnetic force attaching side panels to a base via a board nestled within each side panel bearing a series of permanent magnets that mates with either a ferromagnetic strip or with other permanent magnets properly aligned and in the proper orientation within the base to permit the attractive magnetic force upon actuation, with actuation involving the application of the magnetic force upon the removal of a support pin or other support means holding the magnet bearing board a significant distance away from the ferromagnetic strip or other permanent magnets within the base; and the attractive magnetic force between the base and the magnet bearing board is transferred to the rest of the side panel by a support mechanism emerging from a periphery the side panel that engages the magnet bearing board approximately simultaneously with the magnet bearing board's engagement with the base.

10. The modular casket as in claim 9, comprising:

a.) a dowel for connecting the side panels that has permanent magnets mounted on each end that mate with the permanent magnets within each side panel.

11. The modular casket as in claim 9, comprising:

a.) a dowel for connecting the side panels that has permanent magnets mounted on each end that mate with the permanent magnets within each side panel; and b.) the support pin or other support means possessing a rectangular cross-section.

12. The modular casket as in claim 9, comprising:

a.) a dowel for connecting the side panels that has permanent magnets mounted on each end that mate with the permanent magnets within each side panel;

b.) the support pin or other support means possessing a rectangular cross-section; and c.) compressed springs that force movement of the magnet bearing board towards the base after removal of the support pin or other support means.

* * * * *